United States Patent [19]

Ferrario et al.

[11] Patent Number: 4,951,652

[45] Date of Patent: Aug. 28, 1990

[54] DOMESTIC OVEN WINDOW HAVING A LOW TEMPERATURE EXTERNAL SURFACE

[75] Inventors: Bruno Ferrario; Fabrizio Doni, both of Milan, Italy

[73] Assignee: SAES Getters SpA, Milan, Italy

[21] Appl. No.: 214,487

[22] Filed: Jul. 1, 1988

[30] Foreign Application Priority Data

Jul. 17, 1987 [IT] Italy ..... 21337 A/87

[51] Int. Cl.[5] ..... F23M 7/00

[52] U.S. Cl. ..... 126/200; 126/190; 52/171; 52/172; 52/788

[58] Field of Search ..... 126/198, 190, 200, 443; 52/172, 304, 171, 788

[56] References Cited

U.S. PATENT DOCUMENTS

| | | | |
|---|---|---|---|
| 2,604,886 | 7/1952 | King | 126/200 |
| 2,886,864 | 5/1959 | Boicey et al. | 52/304 |
| 3,192,575 | 7/1965 | Rosenau, Jr. et al. | 126/200 |
| 4,382,177 | 5/1983 | Heaney | 126/200 |
| 4,455,479 | 6/1984 | Itoh et al. | 126/200 |
| 4,546,798 | 10/1985 | Porta | 138/149 |
| 4,579,107 | 4/1986 | Deakin | 126/443 |
| 4,667,607 | 5/1987 | Fleming | 126/200 |

FOREIGN PATENT DOCUMENTS

| | | | |
|---|---|---|---|
| 1046156 | 12/1953 | France | 52/304 |

*Primary Examiner*—James C. Yeung
*Attorney, Agent, or Firm*—David R. Murphy

[57] ABSTRACT

A window for a domestic oven having a reduced thermal transmission so that the external glass surface, which can be touched, is maintained at an acceptable temperature. Between the walls of the window there is an evacuated space. Preferably at least the internal surface of the outer wall is coated with a transparent layer of reflecting material. A non-evaporable getter material is contained within the evacuated space.

9 Claims, 1 Drawing Sheet

DOMESTIC OVEN WINDOW HAVING A LOW TEMPERATURE EXTERNAL SURFACE

It is known that, in function of the temperature that is generated within a domestic oven, whether it is being operated by gas or by electricity, that the external surface of the observation window of the oven may reach temperatures which are dangerous for the safety of people, and especially children, who may inadvertently touch said surfaces.

For example with an oven window consisting of two separate panes of glass separated by a metal frame, it is found that with an internal oven temperature of 250° C. the external surface of the outer window reaches a temperature of 130° C.

Up to the present moment there has been found no satisfactory solution to this problem which also maintains, at the same time, a good visibility of the inside of the oven. The use of thicker glass has not given hoped for results.

Neither would it be useful or advisable to adopt for this application the so called double glazing which consists of two sheets of glass joined together and which may have zeolite in the intermediate space for the sorption of humidity, as this type of construction is mainly used in the building industry etc. and does no appreciably reduce heat transmitted by radiation.

To solve the problem it has also been tried to protect the oven glass with glass doors which protect against accidental direct contact, but this protection exists only until the moment in which the user, in order to observe inside the oven, or a third person such as a child, especially because of curiosity, opens the protective door.

It is therefore an object of the present invention to provide a domestic oven window having a reduced thermal transmission and therefore an acceptable temperature on the external surface such as not to produce burns on accidental contact while at the same time providing good visibility of the inside of the oven.

This is obtained by means of a window which comprises two substantially parallel glass walls joined together by a peripheral border which defines a space which is evacuated.

Furthermore at least the internal surface of the outer wall of the window is covered with a layer of material which is reflecting towards the infra-red and transparent to visible radiation.

Furthermore within the evacuated space there is placed a non-evaporable getter material.

In one preferred embodiment the window is formed from a single piece of pyrex (registered trademark) glass and in a second preferred embodiment the two walls are joined together, preferably along the outer periphery using a vacuum sealing resin, capable of supporting the locally reached temperatures, such as an epoxide resin.

Figure 1:
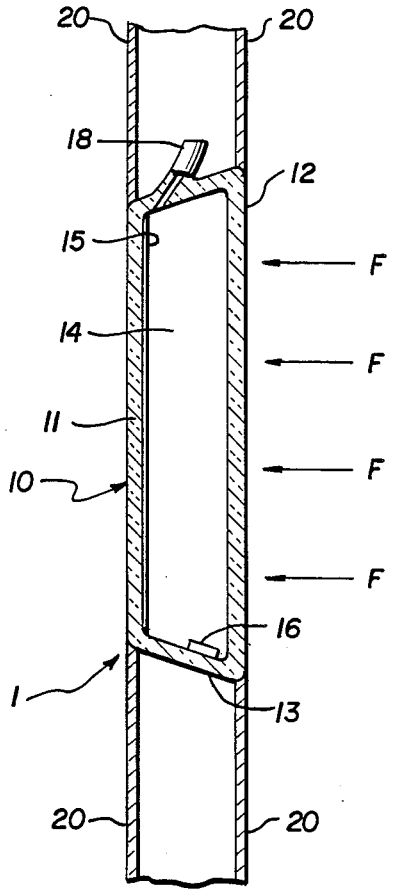
Figure 2:
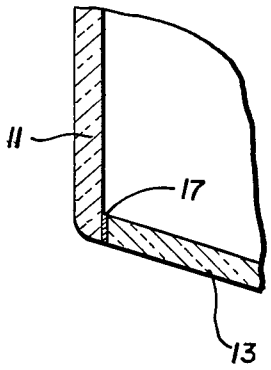

This and other objects and advantages of the present invention will become evident from the following detailed description with reference to the attached drawings wherein:

FIG. 1 is a partial sectional view of an oven door having a window of the present invention; and FIG. 2 is an alternative window of the present invention.

Making reference now to FIG. 1 of the drawings there is shown a domestic oven door 1 containing an observation window 10 which comprises an external wall 11 and internal wall 12 and a peripheral edge 13 which joins said walls in such way as to provide between the two walls 11, 12 a space 14 which is capable of being evacuated by a tubular pumping stem 18 which is initially used for connection to a vacuum pump and then sealed. Pumping stem 18 is conveniently housed between metal sheets 20 of the oven, without any particular problem.

Walls 11 and 12 and the edge 13 are preferably all of pyrex glass (registered trademark) of high mechanical strength and thermal resistance. Window 10 can be formed from a single piece with the stem 18, or as indicated in FIG. 2, it can be formed by bonding to one of the two plane walls, preferably the outer wall 11, the single piece which comprises the other wall 12 and the external periphery 13. The joint 17 which is preferably on the outer wall which is at a lower temperature can be obtained for example by the use of a resin which can give a vacuum tight seal and that is resistant to it such as an epoxy based resin, for example araldite, whose temperature of use reaches a maximum of about 120°-130° C. The vacuum within the space 14 is maintained, according to the invention, by means of a non-evaporable getter material 16 held in any known manner within the space 14 in such a way as not to impede visual inspection through window 10. It must above all sorb gases that are released because of the working temperature of the oven which determines the so called outgassing.

The getter material used is any non-evaporable material capable of sorbing active gases permanently and hydrogen reversibly. Preferably the non-evaporable getter material is chosen from the group consisting of:

(a) an alloy of zirconium and aluminium in which the weight % of aluminium is between 5 and 30%;

(b) a partially sintered mixture of powdered graphite or zeolite with at least one metallic powder chosen from the group comprising Zr, Ta, Hf, Nb, Ti, Th and U, the powder of graphite or zeolite being present up to a weight % of 30%;

(c) a partially sintered mixture of:

(i) particulate Zr—Al comprising from 5 to 30 weight % al Al, remainder Zr , and (ii) at least one metallic powder chosen from the group comprising Zr, Ta, Hf, Nb, Ti, Th and U;

(d) a powdered alloy of Zr—V—Fe whose weight composition in weight when plotted on a ternary composition diagram in weight % Zr, weight % V and weight % Fe lies within a polygon having as its corners the points defined by:

(i) 75% Zr—20% V—5% Fe (ii) 45% Zr—20% V—35% Fe (iii) 45% Zr—50% V—5% Fe;

(e) a partially sintered mixture of:

(i) particles of at least one metal chosen from the group comprising Ti and Zr, and (ii) a powder alloy Zr—V—Fe whose composition in weight % when plotted on a ternary composition diagram in weight % Zr, weight % V and weight % Fe lies within a polygon having as its corners the points defined by:

(i) 75% Zr—20% V—5% Fe (ii) 45% Zr—20% V—35% Fe (iii) 45% Zr—50% V—5% Fe.

The getter material can be positioned freely within space 14 in the form of pills or pellets or fixed in any known way in the form of a tape compacted or pressure bonded onto a metallic support strip.

As can be better seen from the following examples it has been found that there is a drastic reduction in the heat transmission towards the exterior if on the internal surface of external wall 11 there is an infrared reflecting layer 15 which is also transparent to visible light. This layer can be of any known type for instance it may comprise various layers of oxides such as titanium or silicon oxides.

A further improvement of the results obtained concerning the aspect of transmission of heat towards the outside is represented in FIG. 1 by arrow F coming from inside the oven (non shown) can be foreseen by the use of a similar reflecting layer on the external surface of the wall 11. In this case in order to avoid removal of the layer by scratching or due to contact with external bodies it can itself be covered by a protective film of plastic material such as for example nylon. This protective layer can also have a useful anti-implosion function if there is a violent impact capable of breaking wall 11. Either or both of the surfaces of the internal wall !2 can be covered with a reflecting layer having the same characteristics as described above.

The results obtained with an experimental set up designed to simulate the behaviour of a window according to the present invention are illustrated in the following examples.

EXAMPLE 1

Several pyrex windows were manufactured which for easy of construction had a circular form and the front window was attached in a vacuum tight manner to the rest of the window by means of araldite. With respect to the previously described embodiment there was no internal reflecting coating 15. Furthermore in order to avoid reaching temperatures at which the use of the bonding agent cannot be guaranteed the temperature of the experiment was maintained at about 100° C., by heating to this temperature the internal wall of the window. This simulates an internal temperature of the oven. The tests of thermal conductivity were conducted with the space between the wall in air, in rotary pump vacuum and in turbomolecular pump vacuum, obtaining the results in following Table 1.

TABLE 1

| Internal Temperature (°C.) | External Temperature (°C.) | Thermal Flux ($W/m^2$) | Pressure |
|---|---|---|---|
| 98 | 57 | 440 | in air |
| 100 | 50 | 350 | rotary pump vacuum |
| 100 | 51 | 360 | turbomolecular pump vacuum |

It is seen that analogous thermal measurements on a real oven displayed a behaviour similar to this for corresponding temperatures of about 100° C. on the internal part of the window with respect to devices used experimentally in air. For example for an oven temperature of 120° C. the internal window temperature is 100° C. and the external temperature of the window is 56°.0 C with a thermal flux of 450 $W/m^2$. This agreement between the the measurements ensures that the results obtained with an experimental set-up are perfectly transferable to a real oven.

EXAMPLE 2

The importance of reflecting layer 15 is demonstrated in the following Example carried out as Example 1 on the same experimental set up as described which comprises this time the coating 15, still at a temperature of 100° C. on the internal face of the device respectively in the free cases of the space being in air, in rotary pump vacuum (about $10^{-2}$ mbar) and in turbomolecular pump vacuum (less than $10^{-5}$ mbar) The infra-red reflecting layer was a single layer of copper of oxide, 0.1 μm thick. The respective results are given in following Table II.

TABLE II

| Internal Temperature (°C.) | External Temperature (°C.) | Thermal Flux ($W/m^2$) | Pressure |
|---|---|---|---|
| 100 | 44 | 230 | in air |
| 100 | 36 | 110 | rotary pump vacuum |
| 100 | 36 | 100 | turbomolecular pump vacuum |

From a comparison of the previous results it is seen that the reflecting layer 15 gives a significant contribution in reducing the external temperature by about 25% and the thermal flux by about 5% especially under vacuum conditions.

EXAMPLE 3

As a consequence of the results obtained with previous example 2 it was then possible to repeat the tests at real working temperatures of the window in a domestic oven without provoking damage to the characteristics of the resin joint as this joint will remain on the external wall at a temperature less than the critical temperature of 120°-130° C. Therefore three additional tests were carried out all under vacuum conditions of the space at temperatures of 150°, 200° and 220° C. on the internal wall. It is observed that these temperatures correspond to effective working temperatures of the oven which are somewhat higher by about 10 to 20%. For example in a real oven the effective temperature of the oven is 250° C. which corresponds to an internal wall temperature of the window of 217° C. Considering that, in these conditions the thermal flux would have been of 1650 $W/m^2$ it has been found that with the window of the present invention the external temperature reduces by 40% while the thermal flux is reduced by 50%. The results are shown in following Table III.

TABLE III

| Internal Temperature (°C.) | External Temperature (°C.) | Thermal Flux ($W/m^2$) | Pressure |
|---|---|---|---|
| 150 | 57 | 350 | in vacuum |
| 200 | 72 | 700 | in vacuum |
| 220 | 77 | 800 | in vacuum |

It is therefore evident that even under the most severe working conditions the temperature of the external surface of the external wall of the window (77° C.) is substiantially less than conventional oven windows. Probably the use of a second external reflecting layer it would be possible to reach even lower temperatures about 50° C.

Eventual additions and/or modifications can be carried out by those skilled in the art with respect to the above described and illustrated preferred form of the domestic oven window according to the present invention without departure from the spirit and scope of the invention.

What is claimed:

1. A window for a domestic oven, said window comprising:

A. an internal glass wall; and

B. an external glass wall substantially parallel to the internal glass wall; spaced from the internal glass wall; said external glass wall having an internal surface having thereon a layer of material which reflects radiation in the infra-red range and is transparent to visible radiation; and C. a peripheral edge uniting the internal glass wall and the external glass wall and defining a space in which is:

1. a vacuum; and 2. a non-evaporable getter material.

2. A window of claim 1 wherein the internal glass wall, the external glass wall and the peripheral edge are all formed of a single piece of glass; and wherein said window further comprises a tubular element for the evacuation of the space.

3. A window according to claim 1 wherein the uniting is by means of a resin resistant to temperature and capable of holding a vacuum.

4. A window according to claim 3 in which said resin is an epoxy resin.

5. A window according to claim 1 comprising a second layer of transparent material which is reflecting for infra-red radiation, said second layer being on the internal side of said external glass wall.

6. A window according to claim 5 characterized by the fact that said second layer of reflecting material has its outer surface covered with a transparent protective layer of plastic material having anti-implosive characteristics.

7. A window according to claim 1 comprising furthermore an extra transparent layer of material reflecting infra-red radiation on at least one side of the internal wall (12).

8. A window according to claim 1 in which said non-evaporable getter material (16) within said evacuated space (14) is chosen from the group consisting of:

(a) an alloy of zirconium and aluminium in which the weight % of aluminium is between 5 and 30%;

(b) a partially sintered mixture of powdered graphite or zeolite with at least one metallic powder chosen from the group comprising Zr, Ta, Hf, Nb, Ti, Th and U, the powder of graphite or zeolite being present up to a weight % of 30%;

(c) a partially sintered mixture of:

(i) particulate Zr—Al comprising from 5 to 30 weight % of Al, remainder Zr, and (ii) at least one metallic powder chosen from the group comprising Zr, Ta, Hf, Nb, Ti, Th and U;

(d) a powdered alloy of Zr—V—Fe whose weight composition in weight % when plotted on a ternaly composition diagram in weight % Zr, weight % V and weight % Fe lies within a polygon having as its corners the points defined by:

(i) 75% Zr—20% V—5% Fe (ii) 45% Zr—20% V—35% Fe (iii) 45% Zr—50% V—5% Fe;

(e) a partially sintered mixture of:

(i) particles of at least one metal chosen from the group comprising Ti and Zr, and (ii) a powder alloy Zr—V—Fe whose composition in weight % when plotted on a ternary composition diagram in weight % Zr, weight % V and weight % Fe lies within a polygon having as its corners the points defined by:

(i) 75% Zr—20% V—5% Fe (ii) 45% Zr—20% V—35% Fe (iii) 45% Zr—50% V—5% Fe.

9. A window according to claim 8 in which said getter material is in the form of pills or compacted tape on a metal support strip.

* * * * *